US006836913B2

(12) United States Patent
Perrin et al.

(10) Patent No.: US 6,836,913 B2
(45) Date of Patent: Jan. 4, 2005

(54) BEDDING CLAMP

(76) Inventors: George S. Perrin, 2207 Hickory Ridge Dr., Valrico, FL (US) 33594; Richard A. Leschinski, 4083 Carlyle Lake Blvd., Palm Harbor, FL (US) 34685

( * ) Notice: Subject to any disclaimer, the term of this patent is extended or adjusted under 35 U.S.C. 154(b) by 20 days.

(21) Appl. No.: 10/404,236

(22) Filed: Jul. 11, 2003

(65) Prior Publication Data

US 2003/0229973 A1 Dec. 18, 2003

Related U.S. Application Data

(60) Provisional application No. 60/371,765, filed on Apr. 12, 2002.

(51) Int. Cl.[7] ..... A47C 21/02

(52) U.S. Cl. ..... 5/498; 5/504.1; 24/72.5

(58) Field of Search ..... 5/498, 482, 494, 5/496, 503.1, 504.1, 658, 692; 24/72.5

(56) References Cited

U.S. PATENT DOCUMENTS 467,980 A * 2/1892 Levy ..... 40/797
852,180 A * 4/1907 Hoffman ..... 24/72.5
1,195,874 A * 8/1916 Thurston ..... 24/507
2,326,399 A * 8/1943 Shields ..... 24/72.5
2,857,643 A * 10/1958 Tomsic ..... 24/72.5
3,092,848 A * 6/1963 Gronvold ..... 5/495
4,199,830 A * 4/1980 Ogata ..... 5/411
4,825,489 A * 5/1989 Ross ..... 5/497
4,891,856 A * 1/1990 Thornhill ..... 5/496
4,937,904 A * 7/1990 Ross ..... 5/497
5,014,399 A * 5/1991 Grisel ..... 24/72.5
5,072,470 A * 12/1991 Lysiak ..... 5/496
5,148,560 A * 9/1992 Torres ..... 5/496
5,179,743 A * 1/1993 Lanman ..... 5/498
5,377,391 A * 1/1995 Foster ..... 24/72.5
5,815,861 A * 10/1998 LaGrange et al. ..... 5/504.1
6,161,235 A * 12/2000 Smith et al. ..... 5/504.1
6,185,766 B1 * 2/2001 Farrugia ..... 5/498
2002/0062522 A1 * 5/2002 Deckert ..... 5/504.1
2003/0229973 A1 * 12/2003 Perrin et al. ..... 24/72.5

* cited by examiner

*Primary Examiner*—Robert G. Santos
(74) *Attorney, Agent, or Firm*—John M. Harrison

(57) ABSTRACT

A bedding clamp for securing bedding such as a light blanket or sheet on a mattress at selected corners of a bed, which bedding clamp includes a pair of clamp members, each fitted with a clamp hinged to a clamp plate for clamping the bedding therebetween in a friction-fit and securing the bedding in place by means of a band connecting the clamp members and positioned beneath the corners of the mattress. In a preferred embodiment each clamp plate is characterized by a clamp hinged in a clamp opening in the clamp plate and shaped to define a resilient lobe to removably engage a corresponding receiver opening shaped in the clamp plate as the bedding is removably captured between the clamp and the receiver opening. The clamp members are typically connected by an elastic or resilient plastic band and may be quickly and easily manually opened and closed by means of clamp tabs to insert and remove the bedding from between the respective clamps and receiver openings.

20 Claims, 2 Drawing Sheets

Fig. 3
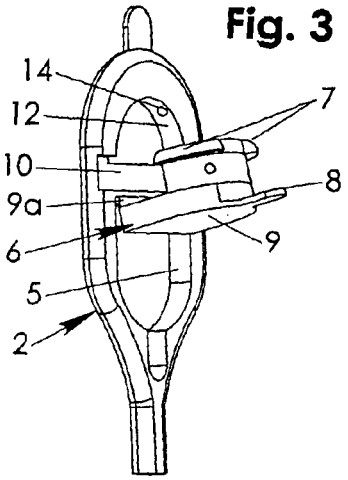
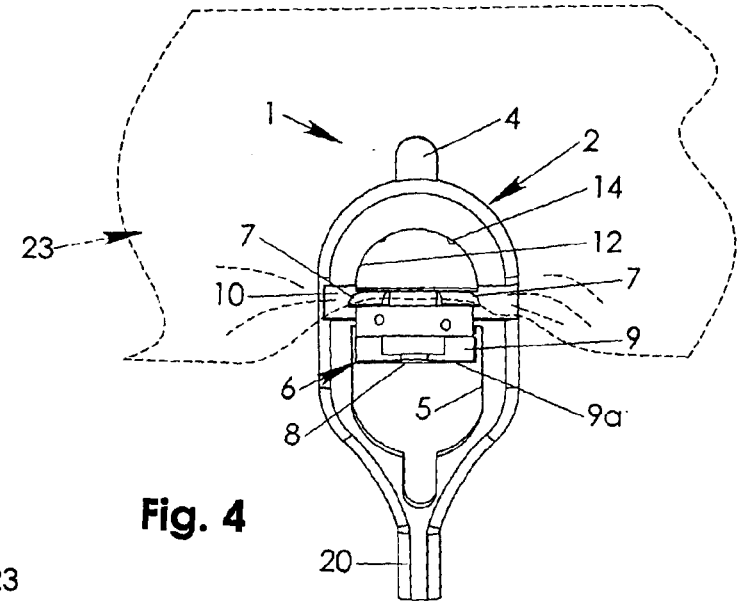
Fig. 4
Fig. 5
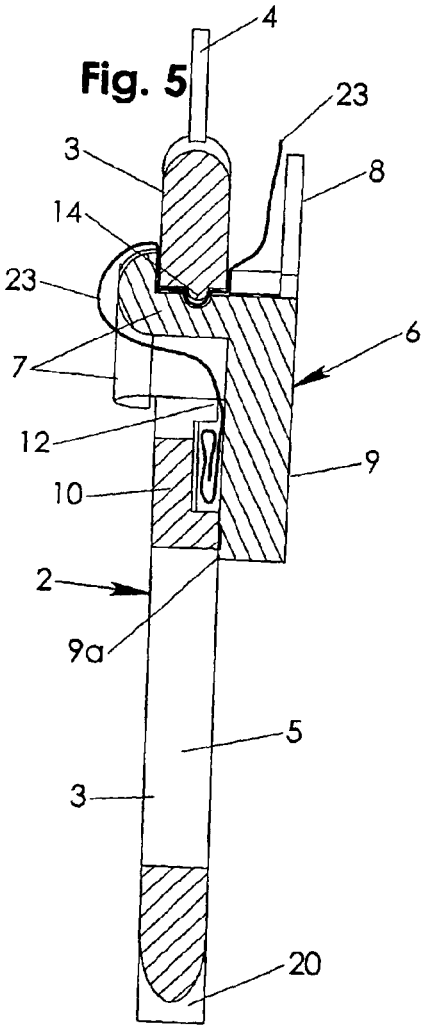
Fig. 6
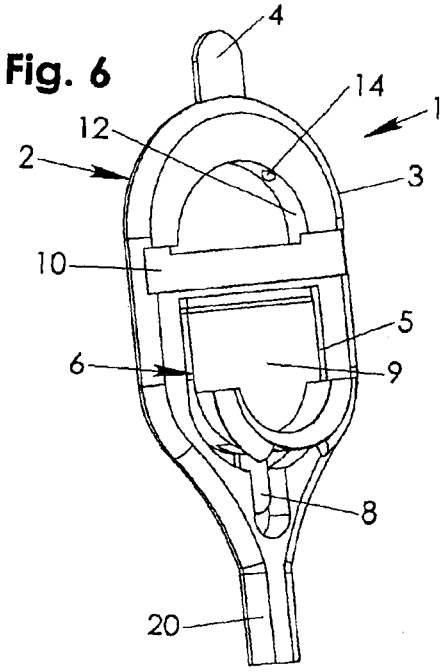

BEDDING CLAMP

CROSS-REFERENCE TO RELATED APPLICATIONS

This application claims the benefit of and incorporates by reference prior filed copending application Ser. No. 60/371,765, filed Apr. 12, 2002.

BACKGROUND OF THE INVENTION

SUMMARY OF THE INVENTION

This invention relates to devices for securing bedding such as sheets and light blankets in position over a mattress at the corners of a bed and more particularly, to a pair of clamp members connected by an elastic or resilient band to define a bedding clamp for the purpose. In a preferred embodiment the clamp members are each characterized by a clamp hinged in or to a clamp plate in a clamp opening, which clamp is fitted with a typically curved plastic clamp lobe that aligns with and engages a corresponding receiver lobe in a receiver opening located in the corresponding clamp plate, to capture in a friction-fit, the bedding between the clamp and the receiver opening on each side of selected mattress corners. Clamp tabs located at the extending ends of the clamps are used to manually open the clamps on the hinges and disengage the bedding from contact with the clamps and the receiver openings when the bedding is to be removed from the clamps. The elastic or resilient, typically plastic band is extended from the two sets of spaced-apart clamp members beneath the respective corners of the mattress to prevent upward movement of the clamp members and the secured margins or edges of the bedding when the bedding clamps are in place.

BRIEF DESCRIPTION OF THE DRAWINGS

The invention will be better understood by reference to the accompanying drawings, wherein:

FIG. 3 is a perspective view of a typical clamp member, more particularly illustrating the hinged clamp and receiver opening used to capture bedding between the clamp and receiver opening and secure the bedding in place;

FIG. 4 is a top view of the clamp member illustrated in FIG. 3, more particularly illustrating a bedding margin or edge inserted between the respective clamp and receiver opening for capturing therebetween in a friction-fit;

FIG. 5 is a side sectional view of the clamp member illustrated in FIGS. 3 and 4, more particularly illustrating the bedding margin captured in a friction-fit between the clamp and the receiver opening when the clamp is closed into the receiver opening; and FIG. 6 is a top perspective view of the clamp illustrated in FIG. 3, in open configuration.

DESCRIPTION OF THE PREFERRED EMBODIMENTS

Figure 1:
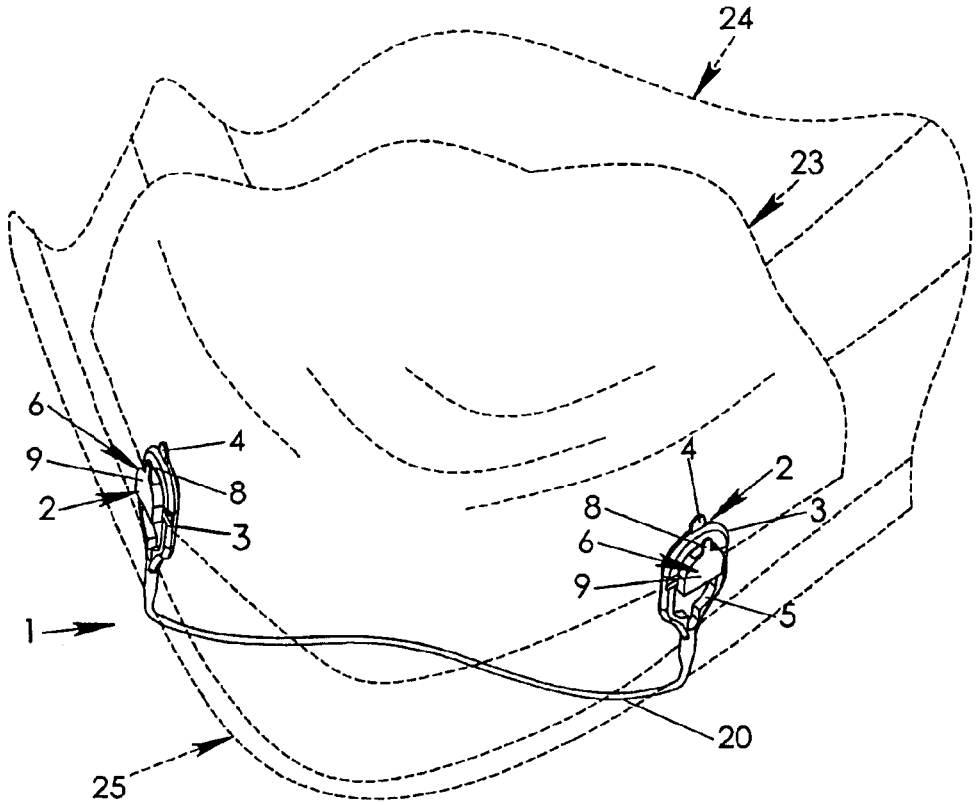
FIG. 1 is a perspective view of a typical application of the bedding clamp of this invention, illustrating a pair of clamp members connected by an elastic band positioned in functional position on a corner of a mattress, to removably secure bedding to the mattress.
Figure 2:
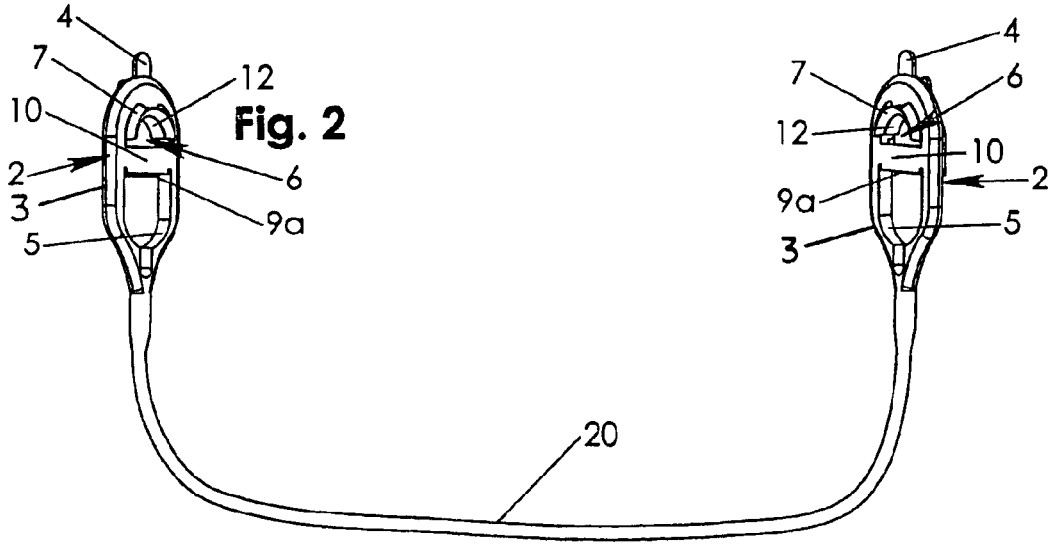
FIG. 2 is a perspective, enlarged view of the clamp members illustrated in FIG. 1, disengaged from the bedding and in clamping configuration.

Referring initially to FIGS. 1 and 2 and 6 of the drawings, in a preferred embodiment the bedding clamp of this invention is generally illustrated by reference numeral 1 and includes a pair of clamp members 2, connected by a connecting band 20, which is typically an elastic or resilient band of selected length, width and resiliency. Each of the clamp members 2 is typically characterized by a typically oval clamp plate 3 of selected thickness, material and size, and typically fitted with a clamp plate tab 4 at the top edge thereof. The clamp plate 3 is further fitted with a clamp opening 5 and a companion receiver opening 12, separated by a plate divider 10, as more particularly illustrated in FIG. 2. The clamp neck 9 of a clamp 6 is hinged along one edge thereof at a neck hinge 9*a*, (typically designed as a one-piece or "living" hinge) to the plate divider 10 (FIGS. 4 and 5) and normally extends into the clamp opening 5 in non-clamped configuration (FIG. 6). A clamp lobe 7 extends, typically in a curved configuration around the typically curved extending end of the clamp neck 9 and a clamp tab 8 extends from the center of the clamp lobe 7 for grasping and bending the clamp neck 9 at the neck hinge 9*a*, as hereinafter described.

Referring now to FIGS. 2–6 of the drawings, in open, unclamped configuration the clamp members 2 are disposed as illustrated in FIGS. 3, 4 and 6 with each clamp 6 capable of disposition in the corresponding clamp opening 5, and in the plane of the clamp opening 5 and the receiver opening 12 (FIG. 6). One or more resilient receiver lobes 14 are shaped or provided in the opposite, typically curved, wall of the receiver opening 12 from the plate divider 10. The receiver lobes 14 are configured to receive the corresponding clamp lobe 7 on the clamp neck 9 of the insert 6 and a target segment of the bedding 23 in a friction-fit when the clamp 6 is hingedly pivoted or bent over the plate divider 10 and closed with the target segment into the slightly oversized receiver opening 12, as illustrated in FIGS. 1 and 5.

As further illustrated in FIGS. 4 and 5, in operation, the edges or margins (target segments) of the bedding 23, such as a sheet defining a corner of the bedding 23, are first positioned between the open clamp 6 and over the receiver opening 12 (FIG. 4). Each target segment of the bedding 23 may then be removably captured by a clamp 6 in the corresponding receiver opening 12 as the clamp lobe 6 is extended by finger or thumb pressure over the plate divider 10 and into the receiver opening 12 and forces the corresponding target segment of the bedding 23 into the receiver opening 12 in a friction-fit, as illustrated in FIG. 5. Referring again to FIG. 1 of the drawings, this action, coupled with the positioning of the connecting band 20 between selected corners of a conventional mattress 24 and the underlying box springs 25 of a bed, maintains the bedding 23 in secure position on the mattress 24. Release of the bedding 23 from each of the clamp members 2 is quickly and easily effected by finger or thumb pressure applied in opposite directions, to the respective clamp tabs 8 on the clamps 6 and the clamp plates tab 4 in the clamp plate 3, to open the corresponding clamps 6 on the corresponding neck hinges 9*a*.

In detailed use, and referring again to FIGS. 1, 4, 5 and 6 of the drawings, when it is desired to secure the edges or margins of a bedding 23 such as a sheet, on the mattress 24 of a conventional bed using a plastic, typically injection-molded bedding clamp 1, the bedding 23 is initially placed on the mattress 24 in conventional fashion with the corners and edges of the bedding 23 extending over the corresponding edges and corners of the mattress 24, as illustrated in FIG. 1. A bedding clamp 1 is then positioned at each selected mattress corner as further shown in FIG. 1, with the respective clamp members 2 spaced-apart from each other across each designated corner of the mattress 24 and the corresponding integrally-formed connecting band 20 extended beneath the corner of the mattress 24, between the mattress 24 and the box springs 25, as further illustrated in FIG. 1. The corresponding clamps 6 of each of the respective clamp members 2 in each set are normally open as illustrated in FIGS. 3 and 6 and each target edge or margin of the bedding 23 extending from the corner of the bedding 23 is placed on a respective clamp plate 3, over the corresponding receiver opening 12, as illustrated in FIG. 4. The respective integrally-formed clamps 6 are then bent on the corresponding neck hinges 9*a*, over the plate divider 10 and closed with the bedding 23 into the corresponding receiver openings 12 as described above, thus removably capturing the bedding 23 between the clamps 6 and the corresponding clamp plate 3 in a friction-fit, as illustrated in FIG. 5.

It will be appreciated by those skilled in the art that the bedding clamps 1 of this invention can be used to selectively secure bedding 23 to a mattress 24 at only the bottom two corners of the mattress 24 or at all four corners of the mattress 24, under circumstances where the top or bottom sheet or blanket is to be secured in place. Furthermore, the respective clamp members 2 are easily opened to release the bedding 23 from contact with each clamp 6 and corresponding receiver opening 12 by directing finger or thumb pressure in the opposite outward directions against the respective clamp tabs 8 and corresponding clamp plate tabs 4 and pivot each clamp 6 on the corresponding neck hinge 9*a*, to the open position, typically back into the plane of the clamp opening 5. Moreover, it will be appreciated that in a preferred embodiment of the invention the band loop 21 of each bedding clamp 1 is molded integrally with the respective clamp members 2 in a single unit, or connected thereto in any convenient manner, to secure the band loops 21 in place on each of the clamp members 2. For example, the connecting band 20 may be constructed of a material such as plastic, of suitable resiliency and/or elasticity that facilitates bending and limited stretching to desired clamp points where the clamp members 2 are secured on the bedding 23 around selected corners of the mattress 24, as illustrated in FIG. 1.

Referring again to FIGS. 4 and 5 of the drawings, in a most preferred embodiment of the invention the clamps 6 may be of any desired size and shape in proportion to the correspondingly-shaped receiver openings 12, to accommodate both the captured or target portions of the margin of the bedding 23 of selected thickness. Furthermore, in another preferred embodiment of the invention the clamps 6 are integrally molded of a plastic material with the respective clamp plates 3 to define a "living neck hinge" 9*a* of selected thickness and resiliency in the clamp neck 9, to facilitate a desired "memory" of the clamp plate 3 in returning to the unclamped configuration in the clamp opening 5. Accordingly, the size and shape of the clamps 6 and the oversized receiver openings 12 may be molded to accommodate sheets in a first set of clamp members 2 and light blankets in a second set of clamp members 2, as deemed necessary to accommodate bedding 23 of selected thickness.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A bedding clamp for securing bedding to a corner of a bed, comprising a pair of clamp members connected by a band, each of said clamp members characterized by a clamp plate; a receiver opening provided in said clamp plate; and a clamp hingedly carried by said clamp plate, said clamp disposed for selectively hingedly engaging the bedding and removably clamping the bedding in said receiver opening when said band is positioned beneath the corner of the bed.

2. The bedding clamp of claim 1 comprising at least one receiver lobe provided in said receiver opening and a clamp lobe provided on said clamp, wherein said clamp lobe removably captures the bedding in said receiver opening against said receiver lobe.

3. The bedding clamp of claim 1 wherein said receiver opening in said clamp plate is oversized with respect to said clamp for accommodating the bedding and said clamp in said receiver opening.

4. The bedding clamp of claim 1 wherein said receiver opening in said clamp plate is oversized with respect to said clamp and comprising at least one receiver lobe provided in said receiver opening and a clamp lobe provided on said clamp, wherein said clamp lobe removably captures the bedding in said receiver opening against said receiver lobe.

5. The bedding clamp of claim 1 comprising a clamp tab provided on said clamp for selectively hingedly manipulating said clamp and the bedding into and from said receiver opening.

6. The bedding clamp of claim 5 wherein said receiver opening in said clamp plate is oversized with respect to said clamp and comprising at least one receiver lobe provided in said receiver opening and a clamp lobe provided on said clamp, wherein said clamp lobe removably captures the bedding in said receiver opening against said receiver lobe.

7. A bedding clamp for securing bedding to at least one corner of a mattress, comprising a band of selected length and resiliency; a clamp member provided on each end of said band, said clamp member comprising a clamp plate; a clamp opening provided in said clamp plate; a clamp hingedly provided on said clamp plate, said clamp normally extending into said clamp opening when said clamp member is in unclamped configuration; and a receiver opening provided in said clamp plate for hingedly receiving said clamp and securing the bedding on the mattress responsive to hingedly closing said clamp and the bedding into said receiver opening and positioning said band beneath the corner of the mattress.

8. The bedding clamp of claim 7 comprising at least one receiver lobe provided in said receiver opening and a clamp lobe provided on said clamp, wherein said clamp lobe removably captures the bedding in said receiver opening against said receiver lobe.

9. The bedding clamp of claim 7 wherein said receiver opening in said clamp plate is oversized with respect to said clamp for accommodating the bedding and said clamp in said receiver opening.

10. The bedding clamp of claim 7 wherein said receiver opening in said clamp plate is oversized with respect to said clamp and comprising at least one receiver lobe provided in said receiver opening and a clamp lobe provided on said clamp, wherein said clamp lobe removably captures the bedding in said receiver opening against said receiver lobe.

11. The bedding clamp of claim 7 comprising a clamp tab provided on said clamp for selectively hingedly manipulating said clamp and the bedding into and from said receiver opening.

12. The bedding clamp of claim 11 wherein said receiver opening in said clamp plate is oversized with respect to said clamp and comprising at least one receiver lobe provided in said receiver opening and a clamp lobe provided on said clamp, wherein said clamp lobe removably captures the bedding in said receiver opening against said receiver lobe.

13. A bedding clamp for securing bedding to at least one corner of a mattress on a bed, comprising a pair of clamp members, each of said clamp members comprising a clamp plate; a clamp opening provided in said clamp plate; a bendable clamp projecting from said clamp plate into said clamp opening; a clamp lobe provided on said clamp; a receiver opening provided in said clamp plate, said receiver opening spaced from said clamp opening; at least one receiver lobe provided in said receiver opening for selectively receiving said clamp, said clamp lobe and the bedding in said receiver opening in a friction-fit; and a resilient band connecting said clamp plate, respectively, of said clamp members for positioning beneath the corners of the mattress, and removably securing the bedding on the mattress responsive to positioning of the bedding between said clamp and said receiver opening and bending said clamp and the bedding into said receiver opening, respectively.

14. The bedding clamp of claim 13 wherein said receiver opening in said clamp plate is oversized with respect to said clamp for accommodating the bedding and said clamp.

15. The bedding clamp of claim 13 wherein said at least one receiver lobe is at least a pair of spaced-apart, resilient receiver lobes provided in said receiver opening.

16. The bedding clamp of claim 13 comprising a clamp tab provided on said clamp for selectively manipulating said clamp and the bedding to and from said receiver opening.

17. The bedding clamp of claim 13 comprising a clamp tab provided on said clamp for selectively manipulating said clamp and the bedding to and from said receiver opening, and wherein:

(a) said receiver opening in said clamp plate is oversized with respect to said clamp for accommodating the bedding and said clamp; and (b) said at least one receiver lobe is a pair of spaced-apart, resilient receiver lobes provided in said receiver opening.

18. The bedding clamp of claim 13 comprising a clamp plate tab provided on said clamp plate for gripping said clamp plate.

19. The bedding of claim 18 comprising a clamp tab provided on said clamp for selectively manipulating said clamp and the bedding to and from said receiver opening and wherein:

(a) said at least one receiver lobe is at least a pair of spaced-apart receiver lobes provided in said receiver opening; and (b) said receiver opening in said clamp plate is oversized with respect to said clamp for accommodating the bedding and said clamp when said clamp is hingedly closed with the bedding in said receiver opening.

20. The bedding of claim 13 wherein said clamp members and said band are integrally fabricated of plastic.

* * * * *